United States Patent [19]

Tamura et al.

[11] Patent Number: 4,593,994

[45] Date of Patent: Jun. 10, 1986

[54] ION FLOW MODULATOR

[75] Inventors: Sakae Tamura, Chiba; Masahiro Hosoya, Yokohama; Takeshi Matsuo; Tsutomu Uehara, both of Yokosuka, all of Japan

[73] Assignee: Kabushiki Kaisha Toshiba, Kawasaki, Japan

[21] Appl. No.: 712,646

[22] Filed: Mar. 18, 1985

[30] Foreign Application Priority Data

Mar. 30, 1984 [JP] Japan ..... 59-62702

[51] Int. Cl.[4] ..... G03G 15/00

[52] U.S. Cl. ..... 355/3 SC; 430/53; 346/159

[58] Field of Search ..... 355/3 R, 3 SC, 3 TE; 430/53, 68; 346/159

[56] References Cited

U.S. PATENT DOCUMENTS

| | | | |
|---|---|---|---|
| 3,623,122 | 11/1971 | Fotland . | |
| 3,680,954 | 8/1972 | Frank | 355/3 SC |
| 4,155,093 | 5/1979 | Fotland . | |
| 4,336,317 | 6/1982 | Ando | 355/3 SC X |
| 4,467,333 | 8/1984 | Seimiya et al. | 346/159 X |

FOREIGN PATENT DOCUMENTS

| | | |
|---|---|---|
| 1522582 | 4/1972 | Fed. Rep. of Germany . |
| 2654563 | 6/1978 | Fed. Rep. of Germany . |
| 56-35150 | 4/1981 | Japan . |

*Primary Examiner*—Arthur T. Grimley
*Assistant Examiner*—J. Pendegrass
*Attorney, Agent, or Firm*—Oblon, Fisher, Spivak, McClelland & Maier

[57] ABSTRACT

An ion flow modulator with high reliability used in a photocopying machine to obtain a high quality image. The ion flow modulator includes an insulating substrate, a common electrode formed on one major surface of the insulating substrate, a plurality of ion flow control electrodes formed on the other major surface of the insulating substrate, a photoconductive layer formed on the insulating substrate and connected to one end of each of the ion flow control electrodes, a first voltage application electrode formed on the insulating substrate and connected to the photoconductive layer, a resistance layer formed on the insulating substrate and connected to the other end of each of the ion flow control electrodes so as to interpose the ion flow control electrodes between the photoconductive layer and the resistance layer, a second voltage application electrode formed on the insulating substrate and connected to the resistance layer, and a DC power source for applying voltages having opposing polarities to the first and second voltage application electrodes. The ion flow passage holes are formed through the insulating substrate and the common electrode. A means is provided for generating ions to pass through the ion flow passage holes.

8 Claims, 12 Drawing Figures

ION FLOW MODULATOR

BACKGROUND OF THE INVENTION

I. Field of the Invention

The present invention relates to an ion flow modulator used in a photocopying machine.

II. Description of the Prior Art

Photocopying machines with an ion flow modulator have been conventionally proposed. The principle of operation of a photocopying machine of this type is given as follows. Light irradiates a document, and light (document image) reflected by the document is guided by an optical system to a photoconductive layer of an ion flow modulator to be described in detail later. The ion flow modulator has an array of a plurality of holes so as to cause ions to flow therethrough. More specifically, ions flow through the respective holes in accordance with intensities of light components irradiating the respective portions of the photoconductive layer. The ions passing through the holes charge a dielectric drum, thereby forming an electrostatic latent image corresponding to the document image. Toner is attracted to the latent image on the dielectric drum, and a toner image is transferred to a copy sheet, thus completing a copying cycle.

An illustrative representation of a conventional ion flow modulator (Japanese Patent Disclosure No. 56-35150) is shown in FIG. 1. Rectangular ion flow control electrodes 12 are formed on an insulating substrate 10 parallel to each other. Ion flow passage holes 14 are formed near end portions of the control electrodes 12, in the substrate 10 and in a common electrode 24 to be described later. A common photoconductive layer 16 is formed on the respective control electrodes 12, and a transparent electrode 18 is formed on the layer 16. A single resistance layer 20 common to the respective holes 14 of the control electrodes is formed at the other end portions of the control electrodes 12. A transparent electrode 22 is formed on the layer 20. A common electrode 24 is formed on the lower surface of the substrate 10. Power sources 26 and 28 are connected to the electrodes 18 and 22 to apply positive and negative voltages to the layers 16 and 22, respectively. These power sources are also connected to the electrode 24. A corona charger 30 as a means for generating an ion flow is arranged under the holes 14. The charger 30 comprises a corona discharge electrode 32 and a shield electrode 34. The electrode 32 is connected to a DC power source 36.

An ion flow generated from the electrode 32 flows through the holes 14 and reaches a dielectric drum (not shown). The number of ions flowing through the holes 14 is controlled by potentials of the electrodes 12 having the holes 14. More particularly, when ions generated from the corona discharge electrode are positive ions, the number of the ions flowing through the holes 14 is decreased by the positive potentials of the electrodes 12, and is increased by the negative potentials. In this manner, the latent image corresponding to the potentials at the electrodes 12 is formed on the dielectric drum (not shown). When light does not irradiate the photoconductive layer 16, the resistance of the photoconductive layer 16 is larger than that of the resistance layer 20, so that the potentials of the electrodes 12 are negative under the control of the power source 28 and the number of ions flowing through the holes is increased. However, when light irradiates the photoconductive layer 16, the resistance of the photoconductive layer 16 is decreased, and the potentials at the control electrodes 12 are controlled by the power source 26, thereby decreasing the number of ions passing through the holes. In this manner, the number of ions passing through control electrodes which receive light is small, but the number of ions flowing through control electrodes which do not receive light is large. Therefore, the latent image corresponding to the optical pattern obtained by the layer 16 is formed on the dielectric drum.

The above-described conventional ion flow modulator has the following problems. First, a stripe pattern is often formed on the copied image, or linear omission of the resultant image tends to occur. These events are based upon variations in thickness of the photoconductive layer. More specifically, potential control of each control electrode is performed by utilizing the resistance of the photoconductive layer along the direction of thickness thereof. When the thickness of the photoconductive layer on the respective control electrodes is nonuniform, the number of ions passing through the respective holes vary even if light uniformly irradiates the photoconductive layer, thereby degrading the copied image quality. In practice, it is very difficult to obtain a uniform thickness of the photoconductive layer. Second, when pinholes are formed in the photoconductive layer along the direction of thickness thereof, the photoconductive layer is subject to dielectric breakdown and DC current flows in the control electrode immediately under such pinholes in the photoconductive layer. In addition, since the holes are rendered conductive by the resistance layer, potentials at all control electrodes cannot be controlled. Third, since light from the document is incident on the photoconductive layer through the transparent electrodes, sensitivity is degraded.

SUMMARY OF THE INVENTION

It is, therefore, an object of the present invention to provide an ion flow modulator wherein the number of ions flowing through respective ion flow passage holes will not vary and stripe pattern and linear omission can be eliminated from the copied image when uniform light irradiates a photoconductive layer, a copy function will not be impaired even if pinholes are formed in the photoconductive layer and a high-sensitivity image can be obtained.

In order to achieve the above object of the present invention, there is provided an ion flow modulator including an insulating substrate having a plurality of ion flow control electrodes on one major surface thereof and a common electrode on the other major surface thereof. The ion flow control electrodes respectively have ion flow passage holes extending through the insulating substrate and the common electrode. A photoconductive layer is formed on the insulating substrate and is connected to one end of each ion flow control electrode. A first voltage application electrode is formed on the insulating substrate at an end of the photoconductive layer which opposes the end having the ion flow control electrodes. A resistance layer is formed on the insulating substrate and connected to the other end of each ion flow control electrode. A second voltage application electrode is formed on the insulating substrate and is commonly connected to the end of the resistance layer which opposes the end having the ion flow control electrodes. Voltages having opposite polarities are applied to the first and second voltage application electrodes. A DC power source is connected to the common electrode. In addition, means is provided for generating ions passing through the ion flow passage holes.

According to the ion flow modulator of the present invention, the resistance of the photoconductive layer along the planar direction thereof is utilized to control potentials at the control electrodes. For this reason, even if the thickness of the photoconductive layer varies, no influence is imposed on the potential control of the control electrodes. The two-dimensional size of the photoconductive layer can be controlled with high precision, so that the number of ions passing through the holes will not vary. In addition, since the potential control of the control electrodes is performed by utilizing the planar direction of the photoconductive layer, the potentials at the control electrodes will not change even if pinholes are formed in the photoconductive layer along the direction of thickness thereof. Furthermore, light directly irradiates the photoconductive layer, thereby providing good sensitivity.

DETAILED DESCRIPTION OF THE PREFERRED EMBODIMENTS

Figure 2:
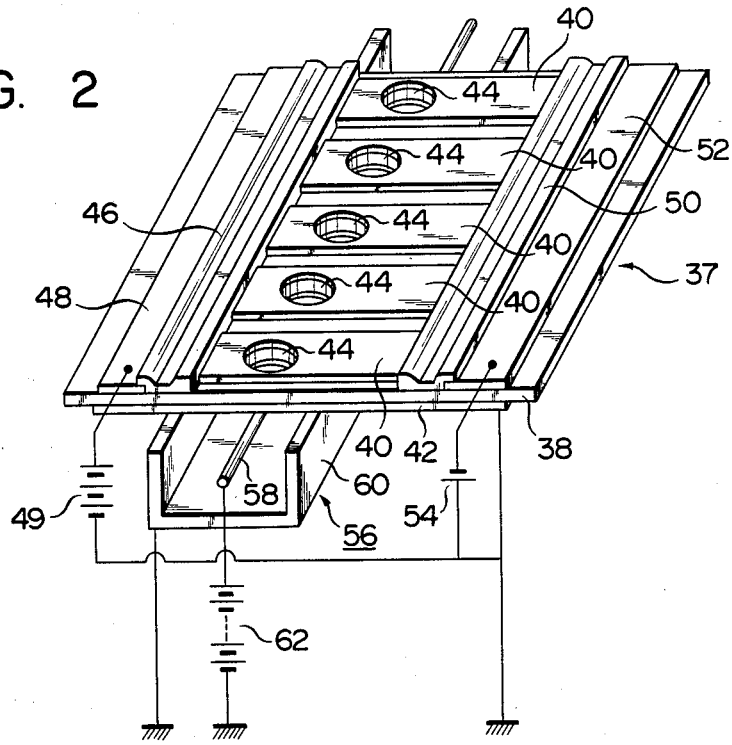
FIGS. 2 and 3 are perspective views of the ion flow modulators according to embodiments of the present invention.

An ion flow modulator according to an embodiment of the present invention is illustrated in FIG. 2. An ion flow modulator 37 includes an insulating substrate 38. Any material which has good insulating properties and which can be subjected to deposition of a metal such as gold or suitable plating material can be used as the substrate. For example, the substrate 38 may be a polyimide film having a thickness of 20 to 100 μm.

A common electrode 42 is formed on the lower surface of the substrate 38. The electrode 42 may be, for example, a gold deposition film having a thickness of 100 nm to 1 μm.

Ion flow control electrodes 40 are formed on the substrate 38 and are parallel to each other. Each electrode 40 may be, for example, a gold deposition film having a thickness of 100 nm to 1 μm. The electrode 40 has a width (i.e., a length along a direction perpendicular to the longitudinal direction thereof) of approximately 30 to 70 μm. The distance between every two adjacent electrodes 40 is approximately 30 to 60 μm. The electrode 40 may be formed of another non-rusting metal such as nickel. Ion flow passage holes 44 extend through the substrate 38 and the electrode 42 and are aligned linearly. Each hole 44 is formed near one end of a corresponding one of the electrodes 40. Usually, each hole 44 has a diameter of 20 μm to 200 μm.

A photoconductive layer 46 is formed on the substrate 38 and is connected to one end of each electrode 44. A photoconductive material is known in the field of electrophotography and includes, for example, amorphous hydrogen silicide and a selenium compound. In addition, an organic photoconductive material such as a phthalocyanine compound can be used in place of the above photoconductive material. An end of the photoconductive layer 46 along the longitudinal direction thereof overlaps the corresponding ends of the electrodes 40. The photoconductive layer 46 preferably has a thickness of 1 to 2 μm.

A first voltage applicatiOn electrode 48 is formed on the substrate 38 and is connected to an end of the layer 46 which opposes the end overlapping the electrodes 40. The electrode 48 serves to apply a positive voltage to the layer 46. The end of the layer 46 which is located at the side of the electrode 48 overlaps the corresponding end of the electrode 48. A first DC power source 49 is connected to the electrode 48 to apply a positive voltage thereto.

A resistance layer 50 is formed on the substrate 38 at the other end of each electrode 40. The resistance layer 50 is connected to each control electrode. The resistance layer 50 may be made of $Si_3N_4$. A second voltage application electrode 52 is formed on the substrate 38 and is connected to the layer 50. The electrode 52 serves to apply a voltage to the layer 50. The two ends of the layer 50 overlap the corresponding ends of the electrodes 40 and 52, respectively. A second DC power source 54 is connected to the electrode 52 so as to apply a negative voltage thereto.

Means 56 for generating ions passing through the holes 44 is arranged thereunder. The ion generating means 56 has the same arrangement as that of the conventional ion flow modulator. The means 56 usually comprises a corona discharge electrode 58 and a shield electrode 60. A high-voltage source 62 is connected to the electrode 58.

The operation of the ion flow modulator according to this embodiment will be described hereinafter. A document image to be copied is guided by a conventional optical system to the photoconductive layer 46. The photoconductive material has a large resistance when it does not receive light. However, the photoconductive material has a small resistance when it receives light. In the layer 46, the portion which actually receives light has a small resistance, but the portion which does not receive light has as large a resistance as usual. The potential at the electrode 40 connected to the portion of the layer 46 which receives light is positive due to the potential at the electrode 48 since the portion has a small resistance. However, the electrode 40 connected to the portion of the layer 46 which does not receive light is set at the negative potential under the control of the electrode 52 through the layer 50 since this portion has the large resistance.

As described above, the electrode 40 connected to the portion of the photoconductive layer 46 which receives light is set at a positive potential, and the electrode 40 connected to the portion which does not receive light is set at a negative potential. In the embodiment shown in FIG. 2, since a positive voltage is applied to the electrode 58, positive ions are emitted therefrom. Positive ions passing through the holes 44 formed in the negatively charged electrodes 40 are attracted by the negative potentials thereof and accelerated, so that a large number of positive ions pass through the corresponding holes 44. However, when positive ions pass through the holes 44 of the positively charged electrodes 40, they are repelled by the positive potential of the holes 44, thereby decreasing the number of positive ions passing therethrough or preventing all the positive ions from passing therethrough. For this reason, an electromagnetic latent image corresponding to an optical pattern formed on the layer 46, i.e., corresponding to the density of the document to be copied is formed on the dielectric drum receiving the positive ions passing through the holes 44.

The ion flow modulator according to this embodiment can be easily manufactured by the following steps. The insulating substrate 38 is prepared, and a metal such as gold is deposited on two surfaces thereof. The deposited film on one surface is etched by a known photoetching technique to form the electrodes 40, the holes 44, and the electrodes 48 and 52. The film deposited on the other surface is used as the common electrode 42 without modification. The layers 46 and 50 are selectively deposited by the well-known CVD method on an exposed portion of the substrate 38 between the electrodes 40 and 48 and an exposed portion thereof between the electrodes 40 and 52. The above individual steps are known to those who are skilled in the art, and a detailed description thereof will be omitted.

The ion flow modulator having the arrangement described above has the following advantages:

(1) Since the layer 46 is formed on the upper surface portion between the electrodes 40 and 48 so as to connect the electrodes 40 and 48, the resistance of the layer 46 is determined by the width thereof. As a result, the resistance of the layer 46 can be accurately controlled to prevent variations in the number of ions passing through the holes 44. When this ion flow modulator is applied to an image forming system, neither the stripe pattern is formed nor does the linear omission occur, thereby providing good image formation.

(2) For this reason, even if pinholes are formed in the layer 46, dielectric breakdown of the layer 46 can be prevented, unlike the structure wherein the photoconductive layer is sandwiched between the ion flow control electrodes and the transparent electrode. As a result, a highly reliable ion flow modulator can be achieved.

(3) Since the layer 46 is not covered with the transparent electrode but is exposed, the sensitivity of the layer 46 will not be degraded when it receives light.

(4) In the above embodiment, the plurality of electrodes 40 and the first and second voltage application electrodes 48 and 52 are formed on the upper surface of the substrate 38. The electrodes 40, 48 and 52 can be easily formed by etching the conductive layer deposited on the substrate 38. Thus, the ion flow modulator can be manufactured at low cost, as compared with that of the conventional stacking type. The layer 46 formed on the upper surface portion of the substrate 38 between the electrodes 40 and 48 can be formed by CVD or evaporation method after the electrodes 40, 48 and 52 are formed. The layer 46 need not be made thick to obtain the prescribed function, thus providing further cost advantage.

(5) Unlike the conventional structure wherein the transparent electrode is stacked on the photoconductive layer, an organic photoconductive material such as phthalocyanine compound can be used as well as stable photoconductive materials such as selenium, its compound and amorphous silicon.

Figure 3:
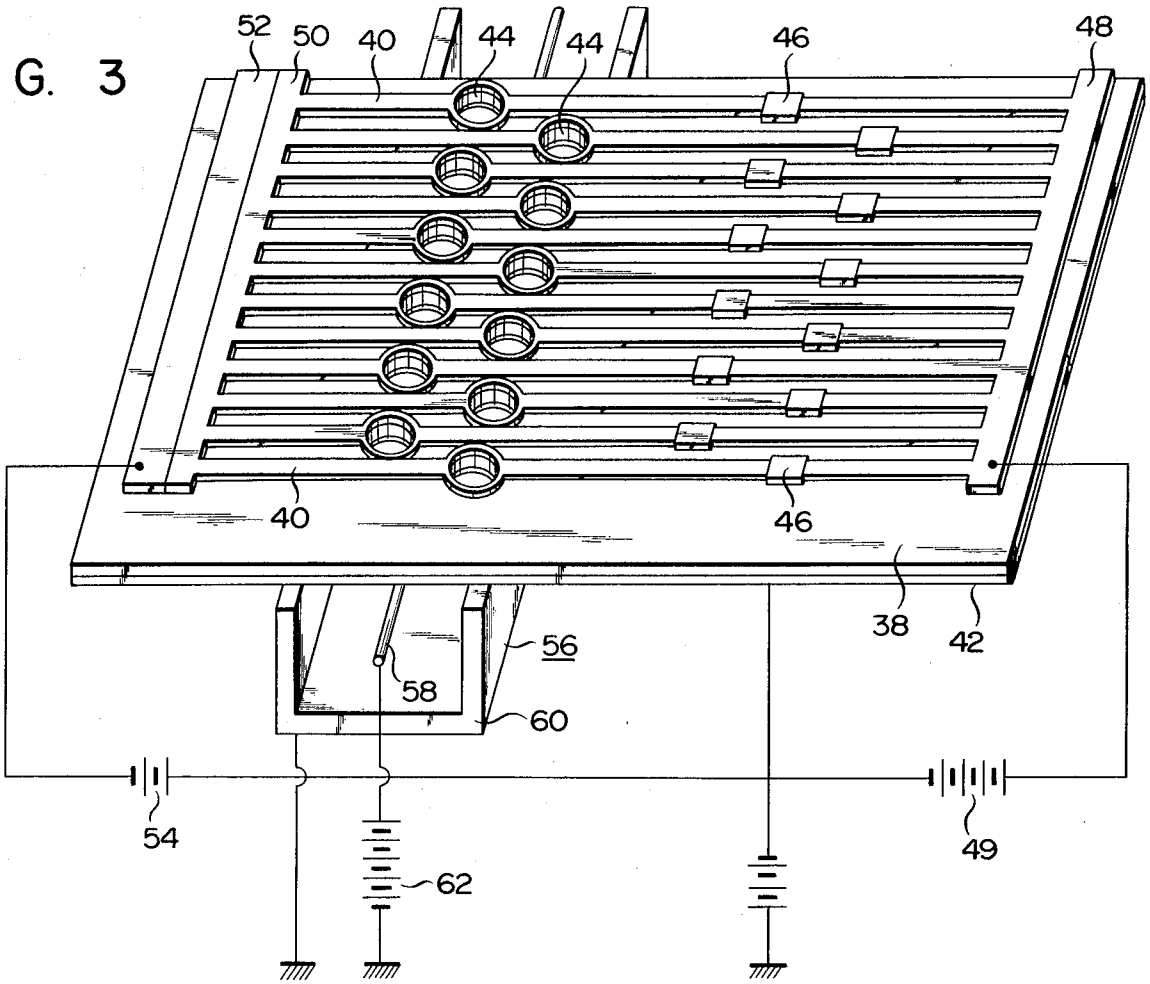

Another preferable embodiment is illustrated in FIG. 3. An ion flow modulator of FIG. 3 is substantially the same as that of FIG. 2, and the same parts as in FIG. 3 denote the same parts as in FIG. 2.

In the embodiment shown in FIG. 3, ion flow passage holes 44 are formed in a staggered manner. Photoconductive layers 46 are formed on ion flow control electrodes 40. The layers 46 are also staggered in the same manner as the holes 44. The diameter of each hole 44 is larger than the width of each electrode 40. The width of the electrodes 40 is approximately 70 μm, and the distance between every two adjacent holes is 30 μm. The width and length of each layer 46 are 80 μm.

According to the ion flow modulator of this embodiment, the holes 40 are dense, and a high quality image can be obtained. The reason will be described with reference to FIGS. 4 and 5.

Figure 4:
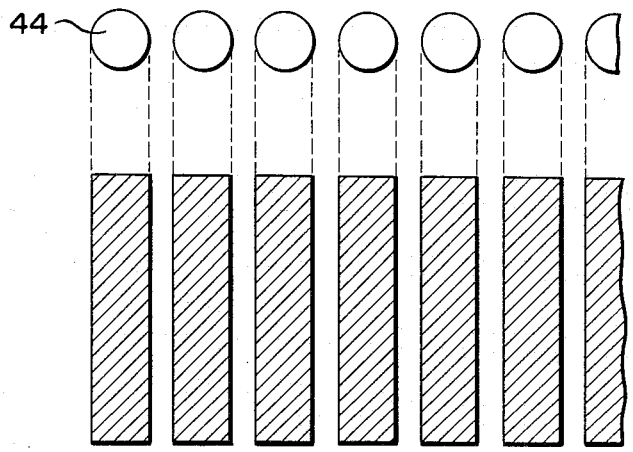
FIGS. 4 and 5 are representations showing the images obtained when a straight line is copied by photocopying machines having an ion flow modulator with ion flow passage holes arranged linearly and in a staggered manner.
Figure 5:
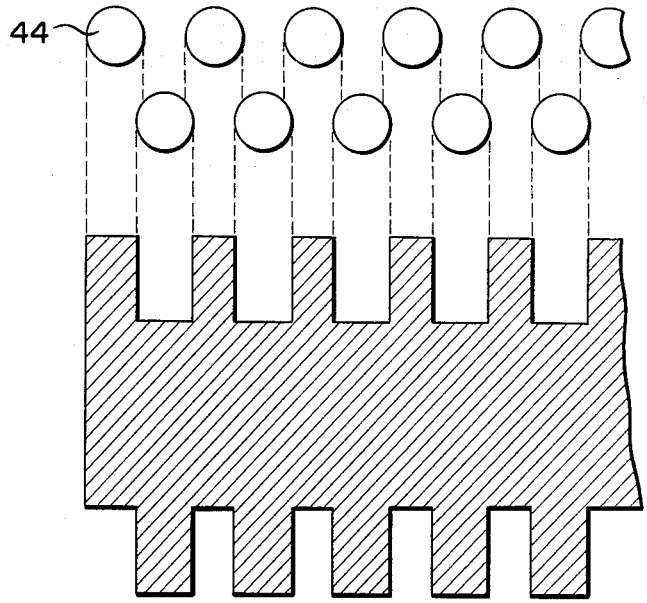

FIGS. 4 and 5 show enlarged images obtained when a single straight line extending along the holes is copied using photocopying machines having holes aligned in line and in a staggered manner, together with the corresponding arrangements of holes. Referring to FIG. 4, when the modulator having the holes 44 aligned in line is used, the straight line is divided into dashes since a gap is present between every two adjacent holes 44. However, when the modulator having the holes 44 aligned in a staggered manner is used, as shown in FIG. 5, the straight line will not be divided into dashes but is given as a continuous line along the alignment direction of the holes 44 since no gap is present between every two adjacent holes. Although the two sides of the straight line region are indented in correspondence with the staggered pattern of the holes 44, when the zigzag pattern of the holes 44 is made as straight as possible without forming a gap between every two adjacent holes 44, the indentation pattern cannot be visually perceived by the naked eye. In this manner, when the holes 44 are staggered, a continuous highquality image can be obtained.

Figure 6:
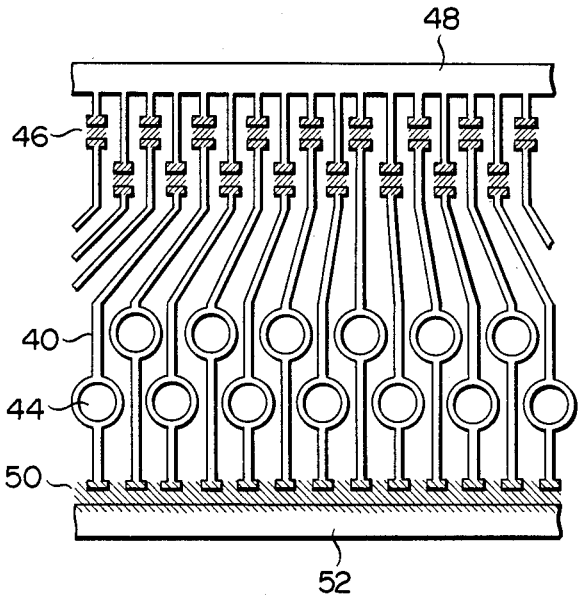
FIGS. 6 and 7 are illustrative representations of ion flow modulators used for enlargement and reduction copy modes.
Figure 7:
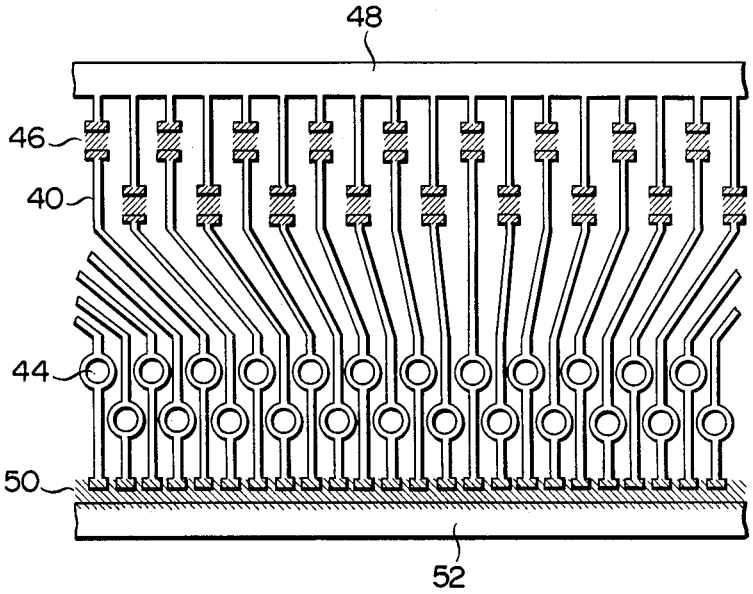

In the embodiment shown in FIG. 3, when the staggered pattern of the holes 44 is the same as that of the layers 46, an image of equal size can be obtained. However, as shown in FIG. 6, when the staggered pattern of the holes 44 is larger than that of the layers 46, an enlarged image can be obtained. Conversely, as shown in FIG. 7, when the staggered pattern of the holes 44 is smaller than that of the layers 46, a reduced image can be obtained. In this manner, according to the present invention, an enlarged or reduced image can easily be obtained.

Figure 8:
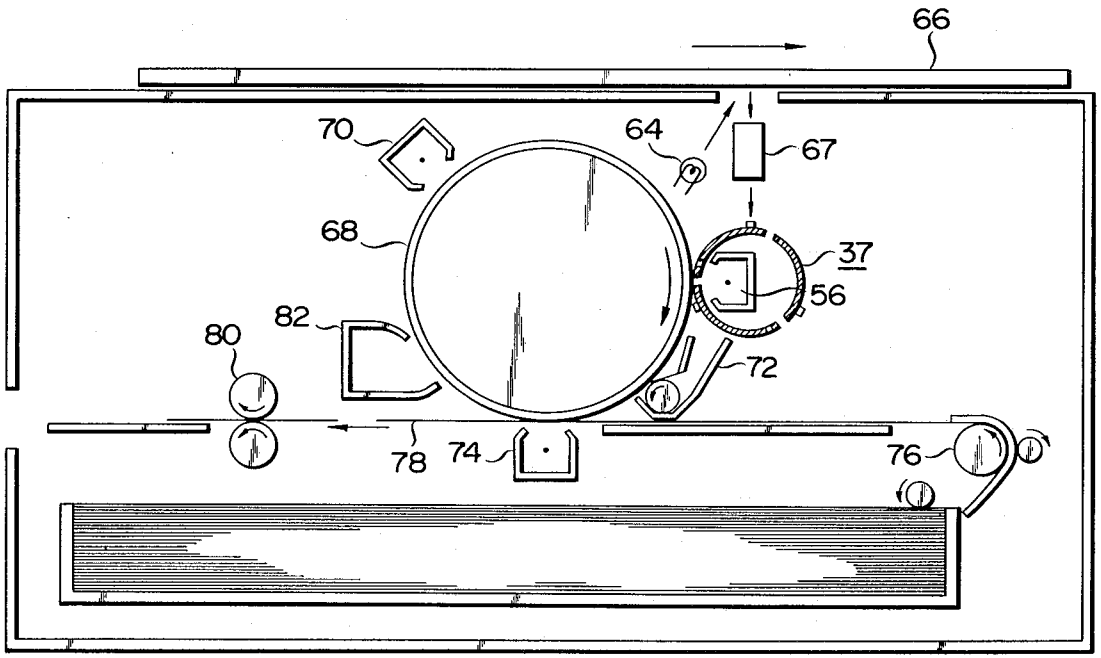
FIG. 8 is a sectional view for explaining the principle of operation of a photocopying machine using an ion flow modulator of the present invention.
Figure 9:
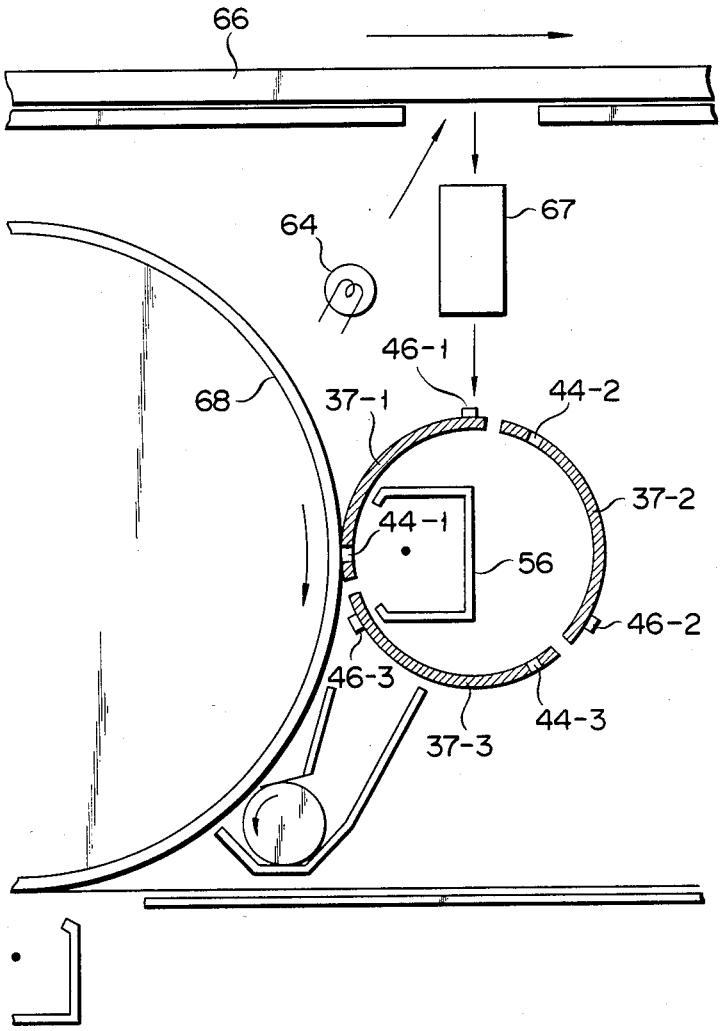
FIG. 9 is an enlarged view of the main part of the photocopying machine shown in FIG. 8.

The ion flow modulator of the present invention can be manufactured in the same manner as in the conventional ion flow modulator. FIG. 8 schematically shows a photocopying machine in which the ion flow modulator of the present invention is applied, and FIG. 9 is an enlarged view showing the main part thereof. As indicated by the direction of the arrow, some of the light components from a light source 64 are reflected by a document placed on a document table 66 and are guided to the ion flow modulator 37 through a light transmission mechanism constituted by a self-focusing lens array. The modulator 37 comprises an equal-size copy mode ion flow modulation unit 37-1, an enlargement copy mode ion flow modulation unit 37-2 and a reduction copy mode ion flow modulation unit 37-3 which are arranged to form a cylinder. In this case, one of the units 37-1, 37-2 and 37-3 is selected by a pivot mechanism (not shown). Ion flow passage holes 44 of the ion flow modulation units are represented by reference numerals 44-1, 44-2 and 44-3. The photoconductive layers 46 of the respective units are represented by reference numerals 46-1, 46-2 and 46-3. FIG. 9 shows an example wherein the unit 37-1 is used. The layer 46-1 opposes the focusing lens array, and the hole 44 oppose a dielectric drum 68 for forming a latent image thereon. A corona charger 70 is arranged to negatively charge the dielectric drum 68. The dielectric drum 68 is rotated in synchronism with movement of the document table 66. Positive ions emitted from the ion generating means 56 and selectively supplied from the electrodes 40 so as to correspond to the density of the document are captured by the dielectric drum 68 through the corresponding holes 44. A latent image is formed on the dielectric drum according to the density of the document. Toner is supplied from a toner hopper 72 and is attracted to the latent image on the dielectric drum. A visible image or toner image is transferred to a sheet 78 fed from a paper feed mechanism 76 to a transfer section 74. The transferred image is then fixed by a fixing mechanism 80 by means of pressure or heat. The residual toner particles on the dielectric drum 68 are removed by a cleaner 82.

The resultant image obtained by this photocopying machine is very precise since the machine incorporates an ion flow modulator having a specific structure. In addition, enlargement and reduction copy modes can be easily selected although these modes hitherto have not been able to be set by using the self-focusing lens array. By differentiating a speed (i.e., the moving speed of the document table 66 in FIG. 8) representing relative movement between the photoconductive layer and the document, and a speed (i.e., the rotational speed of the dielectric drum in FIG. 8) representing relative movement between the holes and the dielectric drum, the copying magnification along the longitudinal direction can be varied from that along the transverse direction. In addition, unlike the conventional electrophotographic copying machine, an expensive photoconductor need not be used in the latent image carrying member, thereby reducing modulator and maintenance cost. The photocopying machine incorporating the ion flow modulator of the present invention need have only a structure wherein light components excluding light components transmitted and reflected from the object are not incident on the photoconductive layer. In this sense, the developing mechanism need not be situated in a dark place, thereby simplifying the modulator arrangement.

Figure 10:
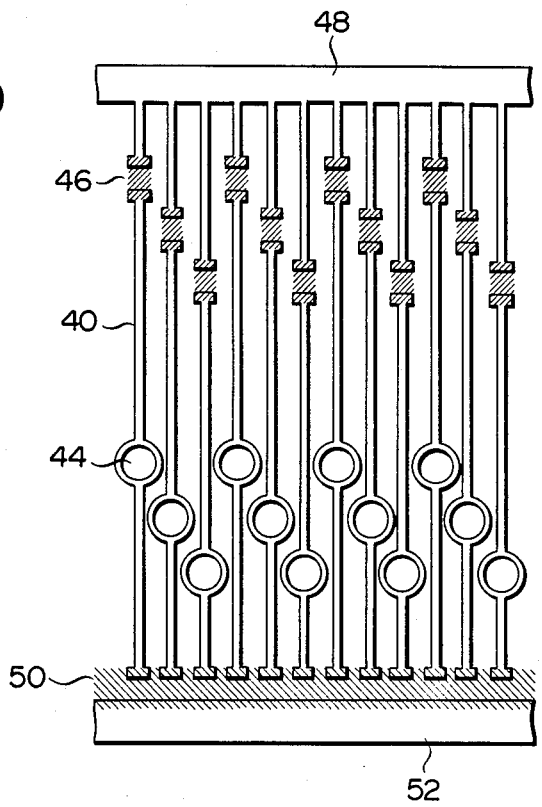
FIGS. 10 to 12 are illustrative representations of ion flow modulators according to other embodiments of the present invention.
Figure 11:
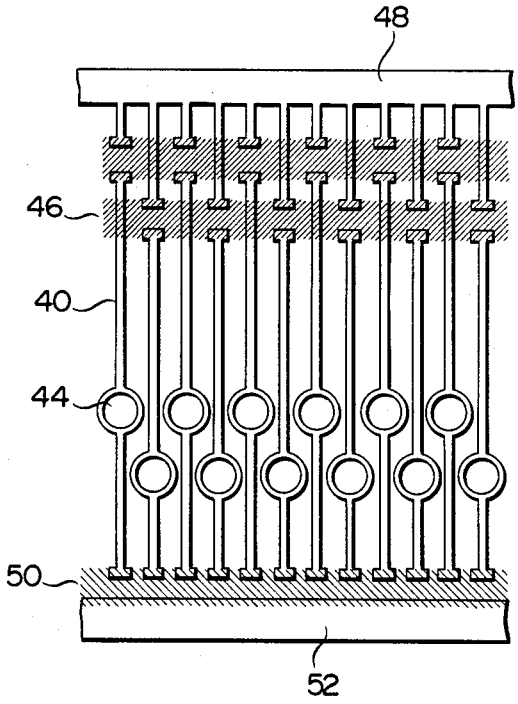
Figure 12:
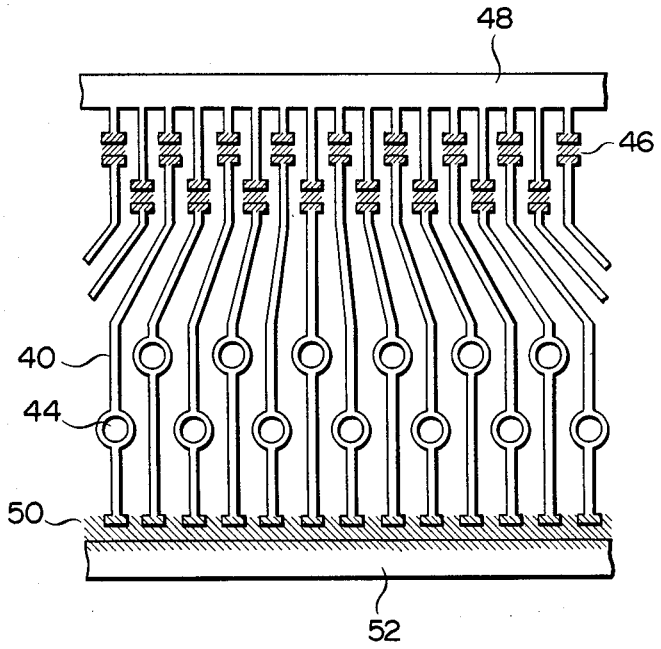

According to the ion flow modulator of the present invention, various other modifications can be made in addition to the embodiments described above. For example, as shown in FIG. 10, the holes 44 can be staggered in three rows. As shown in FIG. 11, photoconductive layers 46 need not be provided for each electrode 40. A continuous photoconductive layer 46 can be formed to cover the disconnected portions of the electrodes 40 in units of rows of the electrodes 40. The above explanation derives from the fact that an erect image is formed on the photoconductive layer, and the relative moving directions between the ion flow modulator and the object and between the modulator and the latent image carrying dielectric body are the same. However, when these moving directions oppose each other, the holes 44 are formed to be symmetrical with the layers 46 about a central line, as shown in FIG. 12.

EXAMPLE 1

The ion flow modulator shown in FIG. 2 was manufactured by the following steps. Nickel was plated on two surfaces of a polyamide film to a thickness of 1 μm. The polyamide film had a thickness of 100 μm. Thereafter, the gold film on one surface was etched to form the electrodes 40, 48 and 52. The nickel film on the other surface was not etched to constitute the common electrode 42. The photoconductive amorphous silicon layer 46 was formed by a combination of a well-known CVD (Chemical Vapor Deposition) method and selective etching. Each of the electrodes 40 and the layer 46 had a width of 0.1 mm, and the layer 46 had a thickness of 1 μm. Subsequently, the holes 44 each having a diameter of 80 μm were formed by a laser beam and extended from the electrodes 40 to the film 38 and to the common electrode 42. Machining was performed such that the distance between every two adjacent holes 44 was 0.15 mm.

Figure 1:
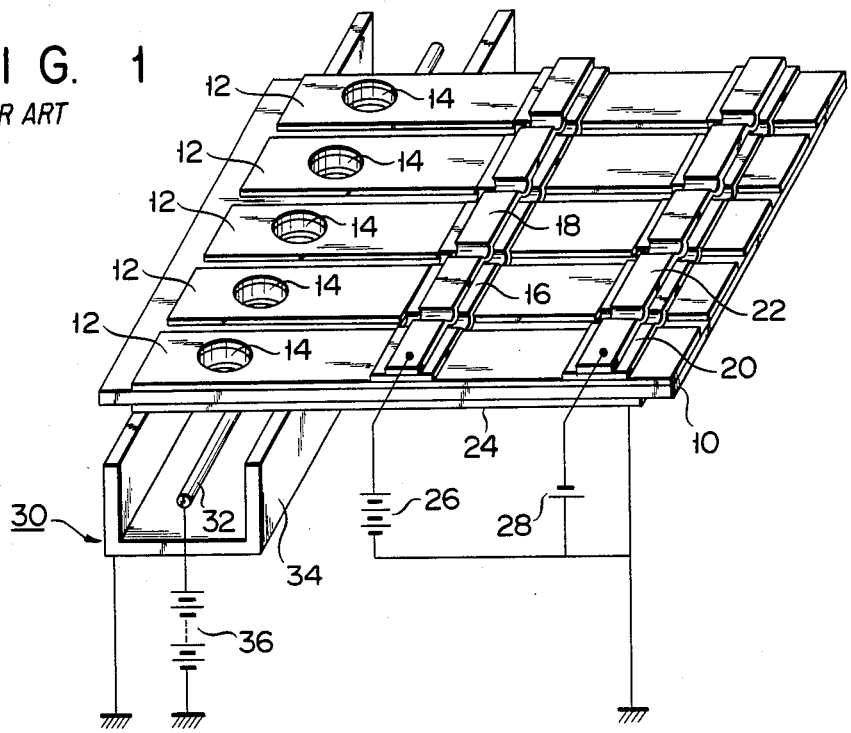
FIG. 1 PRIOR ART
FIG. 1 is a perspective view of a conventional ion flow modulator.

It was found that even if a DC voltage of 800 V was applied between the electrodes 40 and 48 in the resultant ion flow modulator, no dielectric breakdown occurred, and the ion flow could be controlled at high speed. However, in the conventional ion flow modulator of FIG. 1, the dielectric breakdown voltage of the normal photoconductive material is about 100,000 V/cm, so that the thickness of the photoconductive layer must be several ten microns.

EXAMPLE 2

The ion flow modulator shown in FIG. 3 was manufactured by the following steps. Nickel was plated on two surfaces of a polyamide film to a thickness of 1 μm. The polyamide film had a thickness of 50 μm. The nickel film on one surface was etched to form the electrodes 40, 48 and 52, as shown in FIG. 3. The nickel film on the other surface was not etched, thereby constituting the common electrode 42. Each electrode 40 had a width of approximately 20 μm. Each hole 44 had a diameter of approximately 100 μm. Amorphous hydrogen silicide films were deposited by plasma CVD to form the layers 46 each having a size of 80 μm×80 μm. Amorphous silicon was used to form the resistance layer 50 in the same step as in formation of the layers 46. The layer was adhered with a black insulating tape to shield it from light.

When a voltage of 500 V was applied to the electrodes 40 and 48, a dark resistance of each layer 46 of the resultant ion flow modulator was approximately 10 MΩ. In addition, a dark resistance between the electrodes 48 and 40 was approximately 10 MΩ.

By using the resultant ion flow modulator and a dielectric drum having a polyethylene telephthalate layer which constituted the outer surface thereof and which had a thickness of approximately 20 μm, the photocopying machine shown in FIG. 8 was prepared. Voltages of +100 V and −200 V with respect to the potential at the common electrode 42 were applied to the electrodes 48 and 52. A voltage of −1,000 V with respect to the ground potential was applied to the common electrode 42. A voltage of +7 KV was applied to the electrode 58, thereby performing image exposure. As a result, a high quality image was obtained.

EXAMPLE 3

The enlargement and reduction copy mode ion flow modulation units were prepared in the same manner as in Example 2. As for the enlargement copy mode unit, referring to FIG. 6, every three layers 46 were formed to constitute an equilateral triangle whose side had a length of 200 μm. The holes 44 were formed to constitute an equilateral triangle with a side of 200×1.414 μm. Each hole 44 had a diameter of approximately 140 μm which was larger than that of Example 2. In the reduction copy mode unit, one side of the equilateral triangle constituted by the holes 44 had a length of 200 μm, and one side of the equilateral triangle constituted by the layers 46 had a length of 200×1.414 μm. A high quality image was obtained by the photocopying machine using these ion flow modulation units.

EXAMPLE 4

A photocopying machine was prepared in the same manner as Example 4, except that a phthalocyanine or perylene pigment was used to constitute the layers 46. A high quality image was obtained in the same manner as Example 2 when either pigment was used.

What is claimed is:

1. An ion flow modulator comprising:

an insulating substrate;

a common electrode formed on one major surface of said insulating substrate;

a plurality of ion flow control electrodes formed on the other major surface of said insulating substrate, each of said plurality of ion flow control electrodes being provided with one ion flow passage hole, said ion flow passage hole being formed through said insulating substrate and said common electrode;

means for generating ions passing through said ion flow passage hole;

a photoconductive layer formed on said insulating substrate and connected to one end of each of said plurality of ion flow control electrodes;

a first voltage application electrode formed on said insulating substrate and connected to said photoconductive layer;

a resistance layer formed on said insulating substrate and connected to the other end of each of said plurality of ion flow control electrodes so as to interpose said ion flow control electrodes between said resistance layer and said photoconductive layer;

a second voltage application electrode formed on said insulating substrate and connected to said resistance layer; and a DC power source, connected to said common electrode, for applying voltages having different polarities to said first and second voltage application electrodes.

2. The ion flow modulator of claim 1, wherein said photoconductive layer is a single photoconductive layer commonly connected to said plurality of ion flow control electrodes.

3. The ion flow modulator of claim 1, wherein said resistance layer is a single resistance layer commonly connected to said plurality of ion flow control electrodes.

4. An ion flow modulator comprising:

an insulating substrate;

a common electrode formed on one major surface of said insulating substrate;

a plurality of ion flow control electrodes formed on the other major surface of said insulating substrate, each of said plurality of ion flow control electrodes being provided with one ion flow passage hole, said ion flow passage holes being formed through said insulating substrate and said common electrode in a staggered manner;

means for generating ions passing through said ion flow passage hole;

a plurality of photoconductive layers which are formed on said insulating substrate and each of which is connected to one end of a corresponding one of said plurality of ion flow control electrodes, said plurality of photoconductive layers being aligned in a staggered manner similar to that of said ion flow passage holes;

a first voltage application electrode formed on said insulating substrate and connected to said plurality of photoconductive layers;

a resistance layer formed on said insulating substrate and connected to the other end of each of said plurality of ion flow control electrodes so as to interpose said ion flow control electrodes between said resistance layer and said photoconductive layer;

a second voltage application electrode formed on said insulating substrate and connected to said resistance layer; and a DC power source, connected to said common electrode, for applying voltages having different polarities to said first and second voltage application electrodes.

5. The ion flow modulator of claim 4, wherein each of said plurality of ion flow control electrodes has a rectangular shape, and each of said ion flow control holes has a diameter larger than a width of each of said ion flow control electrodes along a direction perpendicular to a longitudinal direction thereof.

6. The ion flow modulator of claim 4, wherein a similar ratio of a staggered pattern of said plurality of ion flow passage holes to that of said plurality of photoconductive layers is 1:1.

7. The ion flow modulator of claim 4, wherein a similar ratio of a staggered pattern of said plurality of ion flow passage holes to that of said plurality of photoconductive layers is not 1:1.

8. The ion flow modulator of claim 4, wherein said resistance layer comprises a single resistance layer commonly connected to said plurality of ion flow control electrodes.

* * * * *